US009365991B2

(12) United States Patent
Cooley et al.

(10) Patent No.: US 9,365,991 B2
(45) Date of Patent: Jun. 14, 2016

(54) FORMED IN PLACE FILLED STRUCTURE WITH SYNTHETIC TURF

(71) Applicant: WATERSHED GEOSYNTHETICS LLC, Alpharetta, GA (US)

(72) Inventors: Bradford Cooley, Chattanooga, TN (US); Michael Ayers, Alpharetta, GA (US)

(73) Assignee: WATERSHED GEOSYNTHETICS LLC, Alpharetta, GA (US)

( * ) Notice: Subject to any disclaimer, the term of this patent is extended or adjusted under 35 U.S.C. 154(b) by 123 days.

(21) Appl. No.: 14/050,440

(22) Filed: Oct. 10, 2013

(65) Prior Publication Data

US 2015/0104257 A1 Apr. 16, 2015

(51) Int. Cl.
*E02B 3/12* (2006.01)
*E02D 17/20* (2006.01)

(52) U.S. Cl.
CPC . *E02B 3/126* (2013.01); *E02B 3/12* (2013.01); *E02B 3/123* (2013.01); *E02D 17/20* (2013.01); *E02D 17/202* (2013.01)

(58) Field of Classification Search
CPC ..... E02B 3/12; E02B 3/122; E02B 3/123; E02B 3/125; E02B 3/126; E02B 3/127
USPC ..... 405/16–18
See application file for complete search history.

(56) References Cited

U.S. PATENT DOCUMENTS

| | | | | | |
|---|---|---|---|---|---|
| 3,396,542 | A | * | 8/1968 | Lamberton | 405/18 |
| 3,517,514 | A | * | 6/1970 | Visser | 405/19 |
| 3,561,219 | A | * | 2/1971 | Nishizawa et al. | 405/19 |
| 3,696,623 | A | * | 10/1972 | Heine et al. | 405/19 |
| 4,135,843 | A | * | 1/1979 | Umemoto et al. | 405/18 |
| 4,449,847 | A | | 5/1984 | Scales et al. | |
| 4,502,815 | A | | 3/1985 | Scales et al. | |
| 4,592,675 | A | | 6/1986 | Scales et al. | |
| 5,575,588 | A | * | 11/1996 | Nakamura | 405/18 |
| 5,651,641 | A | * | 7/1997 | Stephens et al. | 405/302.6 |
| 5,735,982 | A | * | 4/1998 | Prunty et al. | 156/62.2 |
| 2012/0063854 | A1 | | 3/2012 | Ayers et al. | |
| 2012/0230777 | A1 | | 9/2012 | Ayers et al. | |

FOREIGN PATENT DOCUMENTS

| | | | | | |
|---|---|---|---|---|---|
| JP | 55042955 | A | * | 3/1980 | E02D 17/20 |
| JP | 2001207427 | A | * | 8/2001 | E02B 3/08 |

OTHER PUBLICATIONS

International Search Report for PCT/US2014/058110 mailed Mar. 10, 2015.

* cited by examiner

*Primary Examiner* — Frederick L Lagman
(74) *Attorney, Agent, or Firm* — Gardner Groff Greenwald & Villanueva, P.C.

(57) ABSTRACT

A revetment panel construction including a geotextile fabric positioned atop the ground, a synthetic turf positioned atop the geotextile fabric and affixed thereto to form an elongate bladder, and a filling placed within the elongate bladder. Optionally, the revetment panel construction includes a geotextile fabric positioned atop the ground, an elongate filled bladder positioned atop the geotextile fabric, and a synthetic turf positioned atop the filled bladder.

20 Claims, 6 Drawing Sheets

FORMED IN PLACE FILLED STRUCTURE WITH SYNTHETIC TURF

TECHNICAL FIELD

The present invention relates generally to revetments and, in particular, to revetment panel constructions having a synthetic turf affixed thereto.

BACKGROUND

In certain applications it is desired to create a revetment along water ways or standing water, particularly without draining the water therefrom first. In the past it has been known to provide such a revetment as a fillable bladder or a fillable tube subdivided into semi-separate compartments. Unfortunately, in the known revetments, the fillable bladder is known to comprise an upper membrane or geotextile to contain the filling and these upper surfaces can be unsightly and suffer from UV exposure.

Accordingly, it can be seen that needs exist for improved revetment that is attractive, easy to install, and has good UV resistance. It is to the provision of solutions to these and other problems that the present invention is primarily directed.

SUMMARY

Generally described, the present invention relates to revetment panel constructions for installation along embankments and other earthen locations, and including structures which can be partially or fully covered by water at times. The invention can take the form of a revetment panel prior to installation at a site (and prior to filling) or after installation (and filling) at the site.

In a first example embodiment, the revetment panel construction includes a geotextile fabric adapted to be positioned atop the ground, a synthetic turf affixed atop the geotextile fabric and affixed thereto to form a bladder or panel. The bladder can then be filled with a filling placed within the elongate bladder.

The bladder can be formed in such a way that it is subdivided into semi-separate compartments. Moreover, it can be provided with a filling port adjacent one end of the bladder for receiving the filling therethrough.

Optionally, the synthetic turf comprises synthetic blade-like elements tufted into a synthetic backing.

Optionally, the elongate bladder can be filled with sand, other loose material, or cementitious material. In one preferred form, the bladder is filled with concrete. Also optionally, the synthetic turf comprises an elongate strip of synthetic turf.

Preferably, the bladder is elongate and is generally tube-like. In one optional form, two or more of the elongate, generally tube-like bladders are positioned generally abutting one another in side-by-side relationship. Optionally, one or more spacers can be positioned between the bladders. Optionally, the synthetic turf is affixed to the geotextile fabric by heat bonding, adhesive bonding, stitches, mechanical fasteners, or some combination thereof.

In a second example embodiment, the revetment panel construction includes a fillable bladder or panel positioned atop the ground and including a lower geotextile fabric and a synthetic turf positioned over the lower geotextile fabric. The fillable bladder is filled with ballast to form a filled bladder with synthetic turf on top.

Optionally, the synthetic turf comprises synthetic blade-like elements tufted into an upper panel portion of the filled bladder.

Optionally, the filled bladder can be filled with sand, other loose material, or cementitious material. In one preferred form, the filled bladder is filled with concrete. Also optionally, the synthetic turf comprises an elongate strip of synthetic turf.

Preferably, the filled bladder is elongate and is generally tubelike. In one optional form, two or more of the elongate, generally tube-like filled bladders are positioned generally abutting one another in side-by-side relationship. Optionally, spacer can be positioned between the filled bladders.

Advantageously, the revetment panel construction according to the present invention provides good protection against erosion and reinforcement of water control structures. The present revetment panel construction has good durability, low-cost, excellent erosion control and water control, and a rather natural, pleasant appearance.

The specific techniques and structures employed to improve over the drawbacks of the prior devices and accomplish the advantages described herein will become apparent from the following detailed description of example embodiments and the appended drawings and claims.

DETAILED DESCRIPTION OF EXAMPLE EMBODIMENTS

Generally described, the present invention relates to revetment panel constructions for installation along embankments and other earthen locations, and including structures which can be partially or fully covered by water at times.

Figure 1:
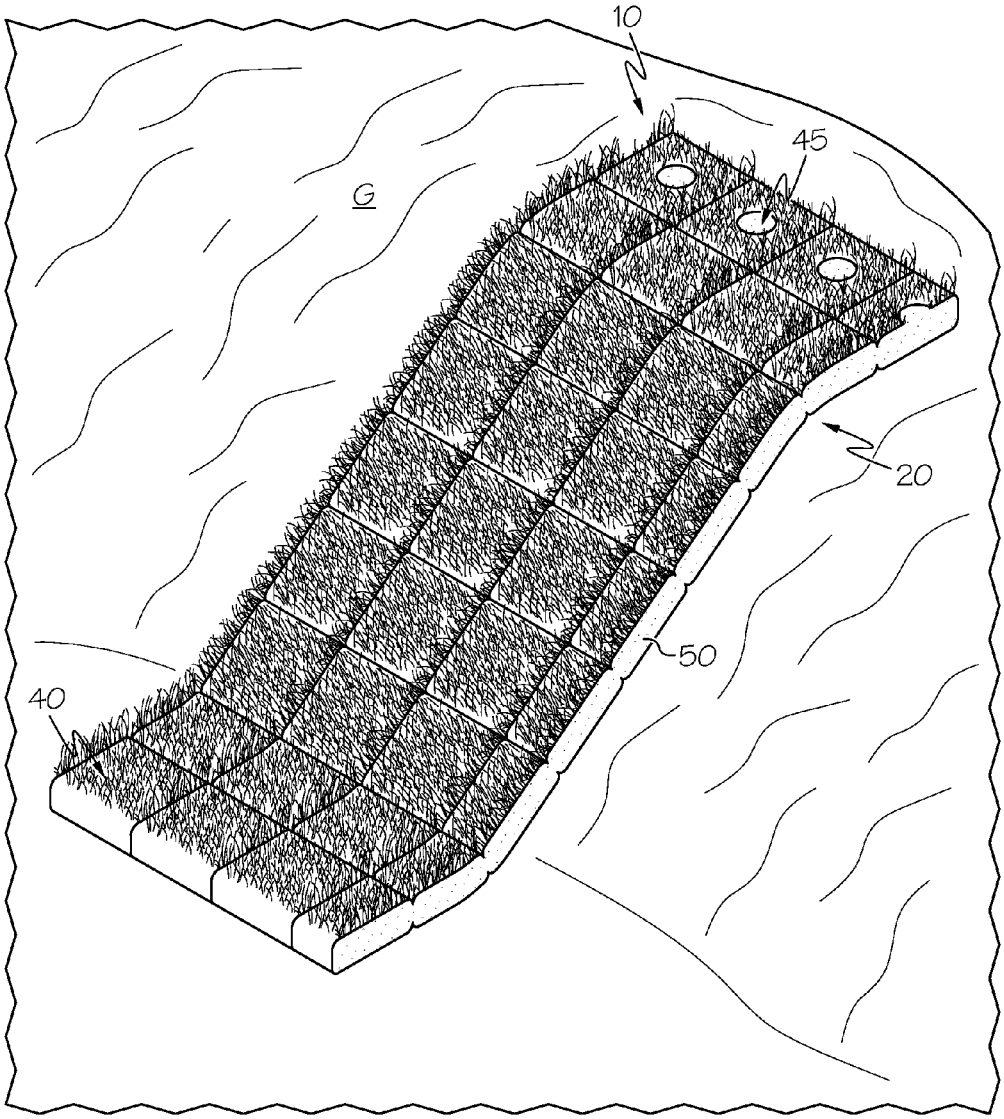
FIG. 1 is a perspective view of a revetment panel construction according to a first example embodiment of the present invention, showing the panel construction positioned atop an embankment.
Figure 2:
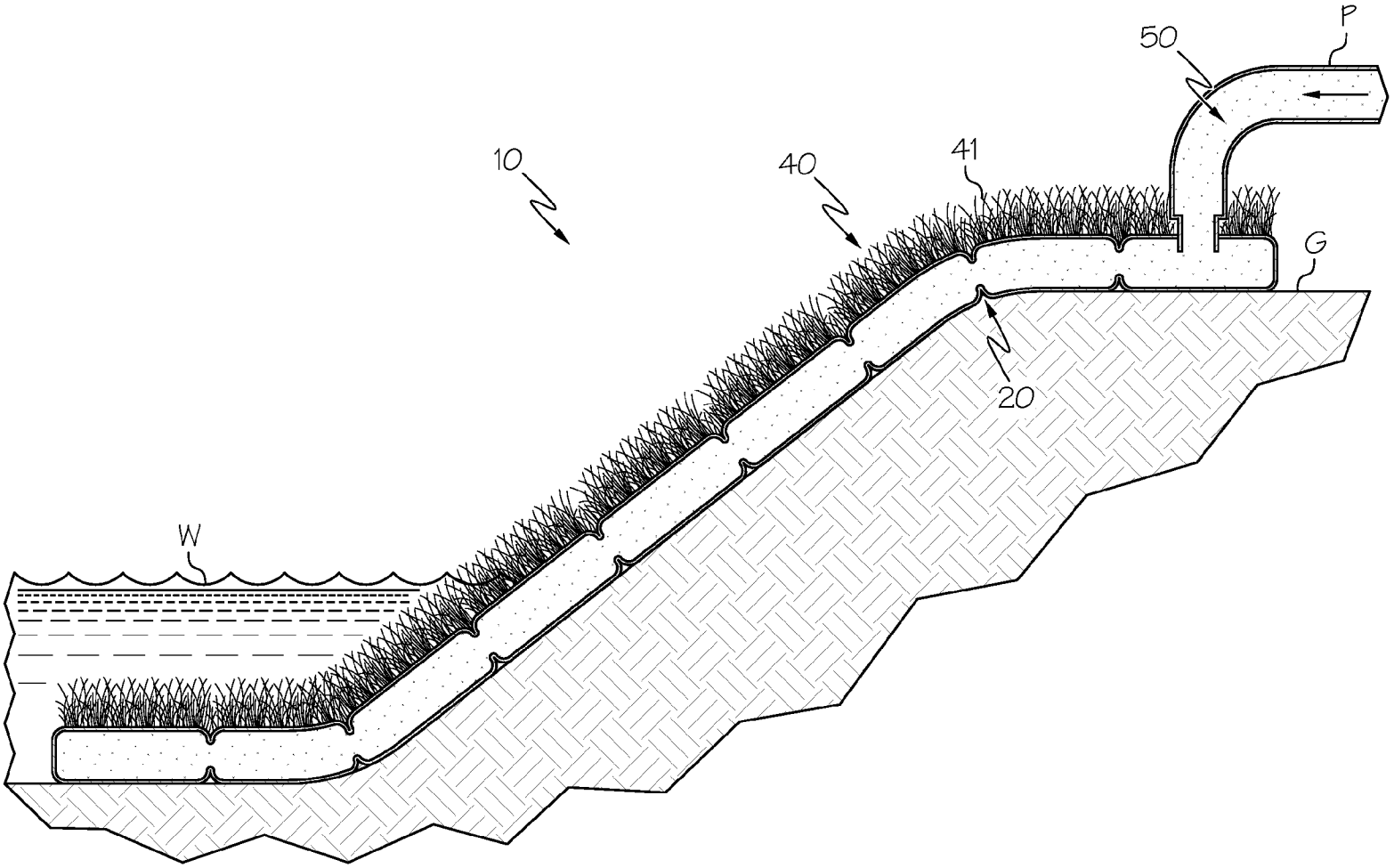
FIG. 2 is a side view of the revetment panel construction of FIG. 1, showing a filling hose secured to the panel construction for filling the bladder with a filling, and wherein a portion of the panel construction is positioned within a body of water.

FIGS. 1-2 show a revetment panel construction 10 according to a first example embodiment of the present invention. Generally, the revetment panel construction includes a geotextile fabric 20 positioned atop the ground G, a synthetic turf 40 positioned atop the geotextile fabric and affixed thereto to form an elongate bladder or panel, and a filling 50 placed within the elongate bladder.

In one example form, the geotextile backing or base panel or sheet 20 preferably consists of one or more geotextiles made of polypropylene or polyethylene with UV stabilizers.

The geotextiles can comprise slit film (tape yarn) or monofilament. Generally speaking, the lower the surface area of the yarn per unit weight of raw material, the better the ultraviolet (UV) performance. Monofilament geotextiles typically have a small cross section relative to their length, which inherently provides for a smaller surface exposed to UV light per unit weight of polypropylene or polyethylene. In other words, a yarn with a round cross-section typically will exhibit better UV resistance than a flat geometric shape.

Optionally, the geotextile fabric or sheet 20 can be a single layer backing, a double layer backing, or can have more than two layers. But it is preferred that a single layer or double layer backing be used. Optionally, the backing can be made of polypropylene or polyethylene. Also, optionally a separate membrane can be dispensed with, such as by applying a membrane-like layer to the back side of the synthetic geotextile. For example, a urethane coating can be sprayed onto the back of the synthetic geotextile and allowed to cure.

Figure 3:
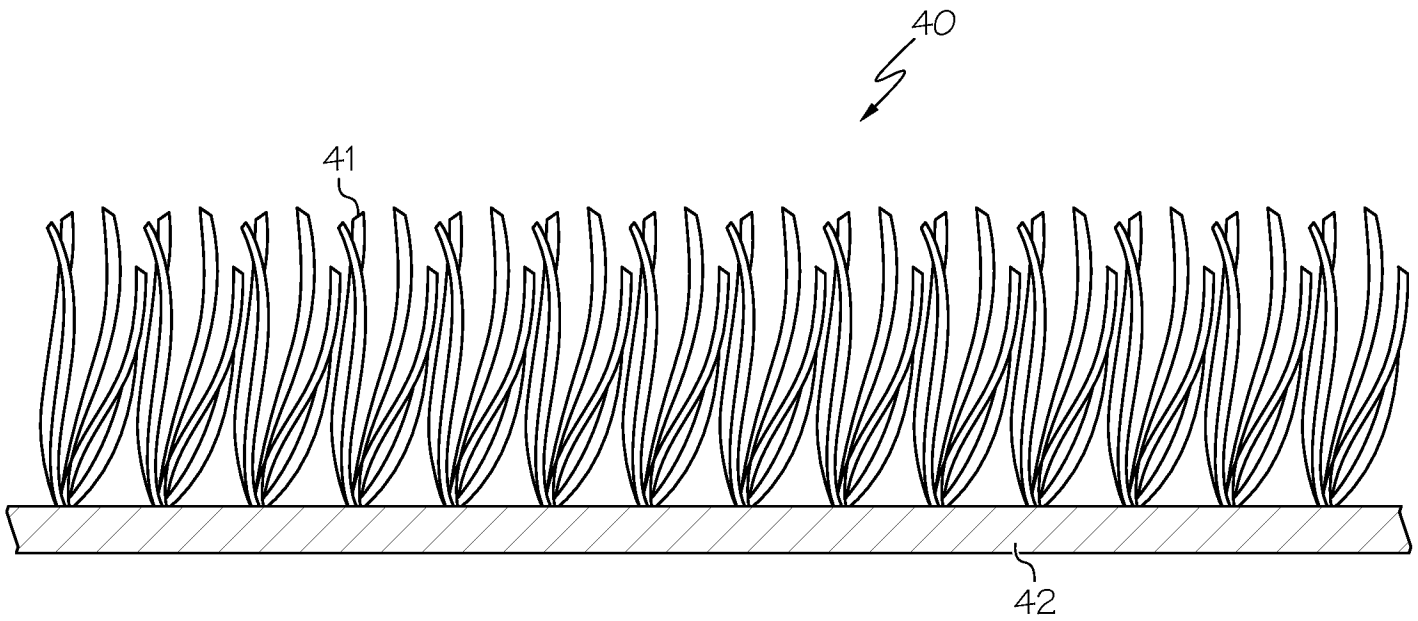
FIG. 3 is a partial side view of the synthetic turf shown in FIGS. 1-2, showing the synthetic blade-like elements tufted into the synthetic backing.

In one example form, the synthetic turf 40 comprises synthetic blade-like elements 41 tufted into a synthetic substrate or backing 42 (see FIG. 3). U.S. Patent Application No. 2012/0063854, U.S. Patent Application No. 2012/0064262, and U.S. Patent Application No. 2012/0064263 show examples of synthetic turf and are incorporated by reference herein in their entirety. Preferably, the synthetic turf 40 is used as a principal component of the system. The synthetic turf 40 can be constructed using a knitting machine or tufting machine that may use, for example, over 1,000 needles to produce a turf width of about 15 feet. Preferably, the synthetic turf includes synthetic grass blades 41 which comprise polyethylene monofilament and/or slit-film fibrillated and non-fibrillated fibers tufted to have a blade length of between about 0.5 inches and 4 inches. Other polymers can be used for the synthetic grass blades, as desired. Preferably, the synthetic grass blades 41 are tufted to have a blade length of between about 1.5 inches and 3 inches. Most preferably, the synthetic grass blades 41 are tufted to have a blade length of about 1.5 inches. Optionally, the synthetic grass blades 41 are tufted to have a density of between about 20 ounces/square yard and about 120-ounces/square yard. Preferably, the synthetic grass blades have a thickness of at least about 100 microns.

In example forms, the backing 42 that the synthetic grass blades 41 are tufted into can comprise a synthetic woven or non-woven fabric. Moreover, this backing can be a single ply backing or can be a multi-ply backing, as desired. Optionally, a geo filter (unshown) can be secured to the substrate/backing to reinforce the substrate and better secure the synthetic grass blades. Alternatively, the backing 42 can be coated with polymers, like polyethylene or polyurethane.

Preferably, the chemical composition of the synthetic turf components should be selected to resist degradation by exposure to sunlight, which generates heat and contains ultraviolet radiation. The polymer yarns should not become brittle when subjected to low temperatures. The selection of the synthetic grass color and texture should be aesthetically pleasing.

The grass-like components preferably consist of green and/or tan polyethylene fibers 41 of about 1.5 to about 2.5 inches in length tufted into a woven or non-woven geotextile(s). For added strength in severely steep sideslopes, an additional geo filter component backing can be tufted for improving dimensional stability. The polyethylene grass filaments 41 preferably have an extended operational life of at least 15 years.

In example forms, the revetment panel 10 is formed such that the synthetic turf 40 is affixed to the geotextile fabric 20 by one or more of heat bonding, adhesive bonding, stitches, or mechanical fasteners. In a preferred form, the synthetic turf is affixed to the geotextile fabric 20 along the edges thereof to form a more or less tubular construction. Optionally, a relatively wide synthetic turf panel 40 is stitched or otherwise affixed to the geotextile fabric 20 along the edges and in the middle thereof, so that the construction resembles multiple narrow tubular elements which are much longer than they are wide. Alternatively, the tubular elements can be further divided with crosswise affixation to achieve a more or less pillow-like or quilted-like structure.

Figure 4:
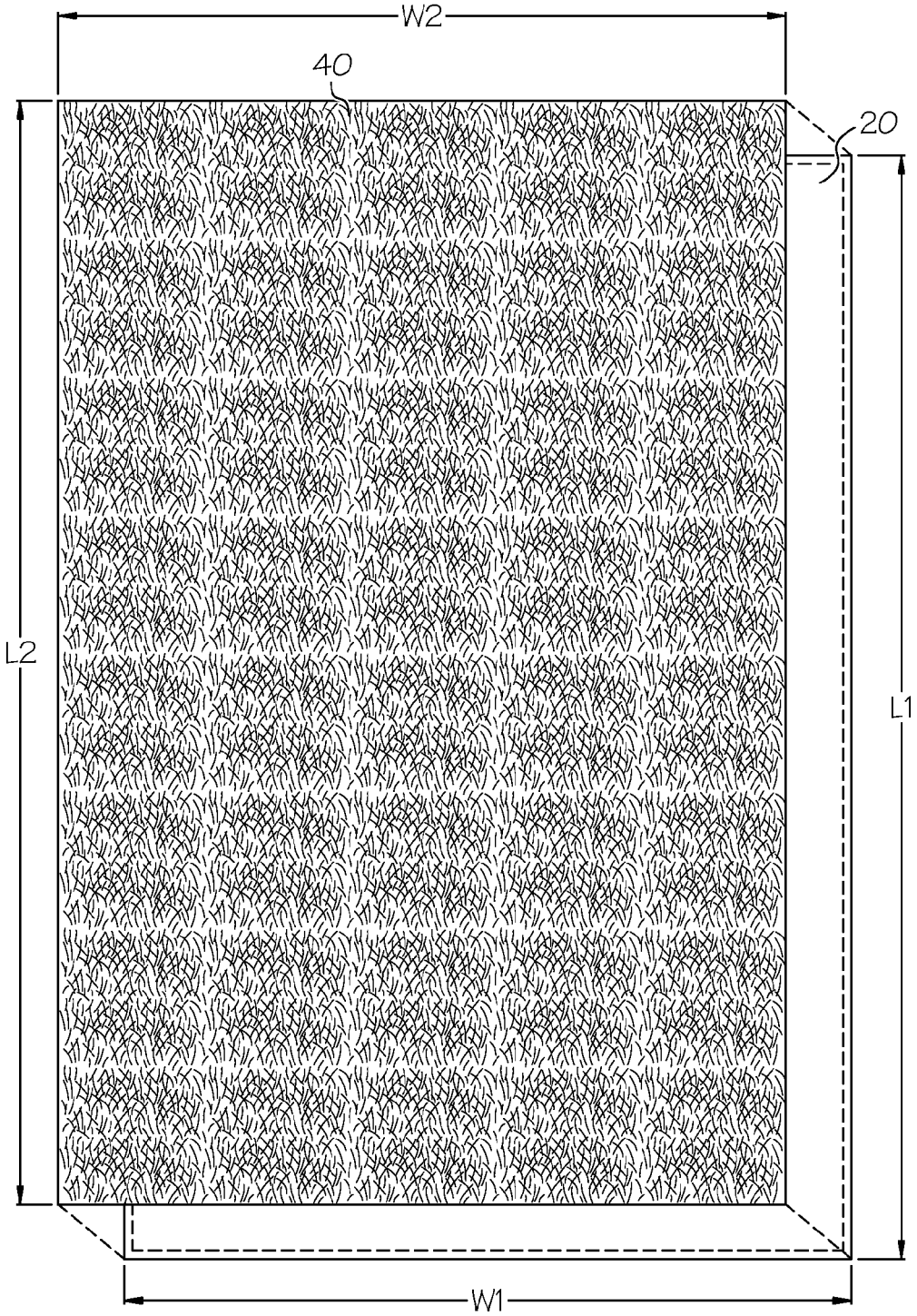
FIG. 4 is an assembly view of the geotextile fabric and the synthetic turf.
Figure 5:
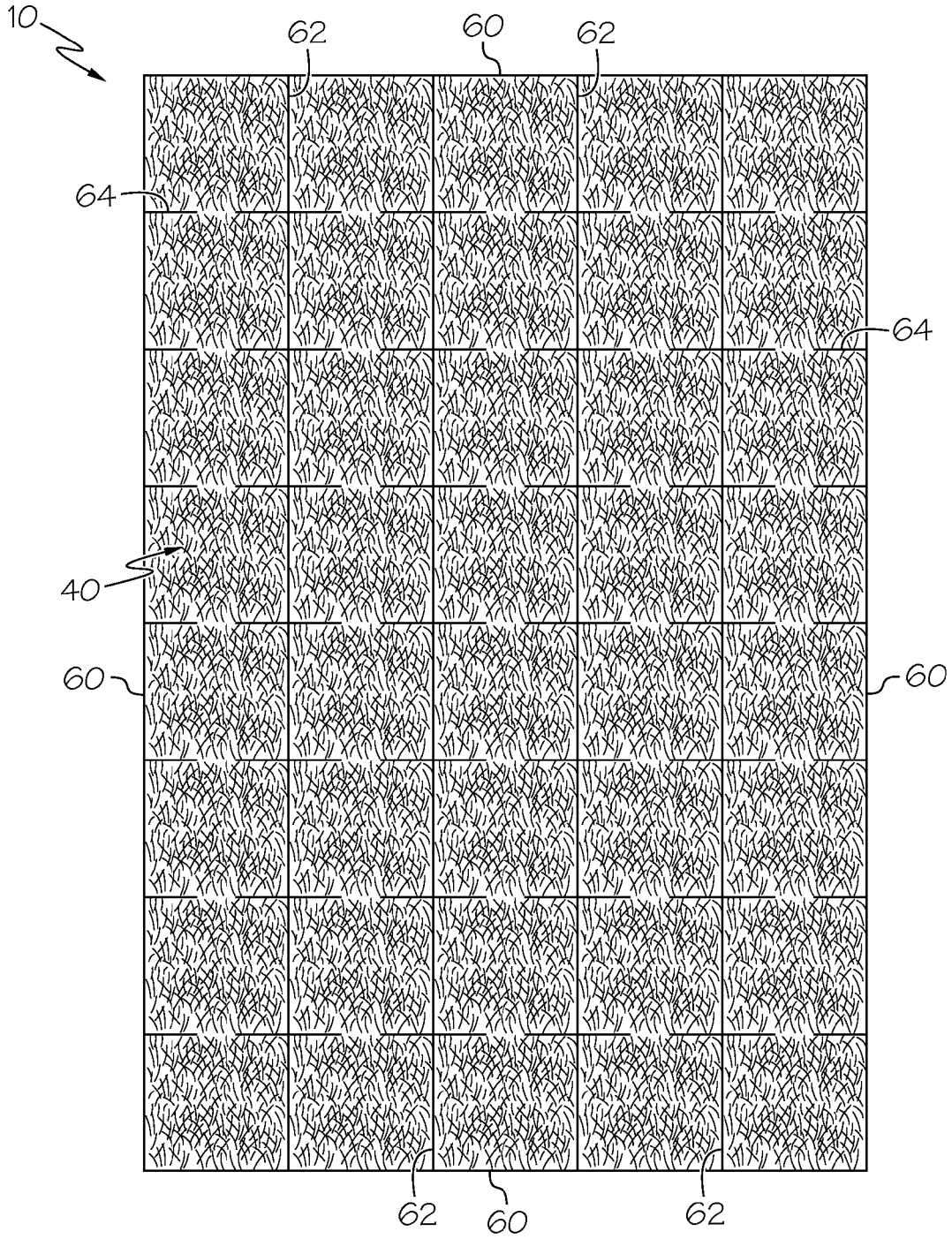
FIG. 5 is a plan view of the geotextile fabric affixed to the synthetic turf, showing the portions thereof which are affixed together.

For example, FIGS. 4-5 show an example embodiment of the assembly and manufacture of the revetment panel construction 10. As depicted in FIG. 4, the synthetic turf 40 is placed atop the geotextile fabric 20. In typical forms, the geotextile fabric 20 and the synthetic turf 40 generally comprise substantially similar dimensions. For example, in one example embodiment, the geotextile fabric 20 and the synthetic turf 40 generally have widths W1, W2 of about 15' feet and lengths L1, L2 of about 75' feet. Optionally, other widths and lengths can be used as desired, for example, to accommodate the landscape and dimensions of the ground G where the revetment panel 10 is to be placed. In one example form, the synthetic turf 40 is affixed to the geotextile fabric 20 along the edges thereof to form a more or less tubular construction, thereby forming a bladder therein where the filling 50 can be placed. In another form, the synthetic turf 40 is affixed to the geotextile fabric 20 along the edges and in the middle thereof, thereby forming two narrow tubular elements or bladders where the filling 50 can be placed. In yet another form, and as depicted in FIG. 5, the synthetic turf 40 is affixed to the geotextile fabric 20 along the edges (forming outer seams 60), in the middle thereof (forming length-wise seams 62), and in a cross-wise pattern (forming cross-wise seams 64) to form a plurality of more or less pillow-shaped or quilted-like structures in volumetric communication with one another so that the bladder can be filled at one end thereof and the filling can flow or communicate from one chamber or subvolume within the bladder to another. Thus, the filling can be pumped into one end of the bladder and flow by gravity and/or fluid pressure.

In one example form, the configuration of the plurality of seams of the revetment panel construction 10 defines an 8×5 matrix of tuft-like structures. In one form, the plurality of tuft-like structures in each column communicate therewith wherein at least a portion of the cross-wise seams 64 are omitted to allow the filling 50 to flow within and therethrough. As depicted in FIG. 5, the omitted portions of the cross-wise seams 64 are generally aligned similarly along a central axis of each column. Optionally, the omitted portions of the cross-wise seams 64 can be positioned as desired, for example, to vary the texture of the overall revetment panel construction 10. In example forms, a zig-zag pattern can be used to for the omitted portions of the cross-wise seams 64, although other patterns can be employed as desired.

Figure 6:
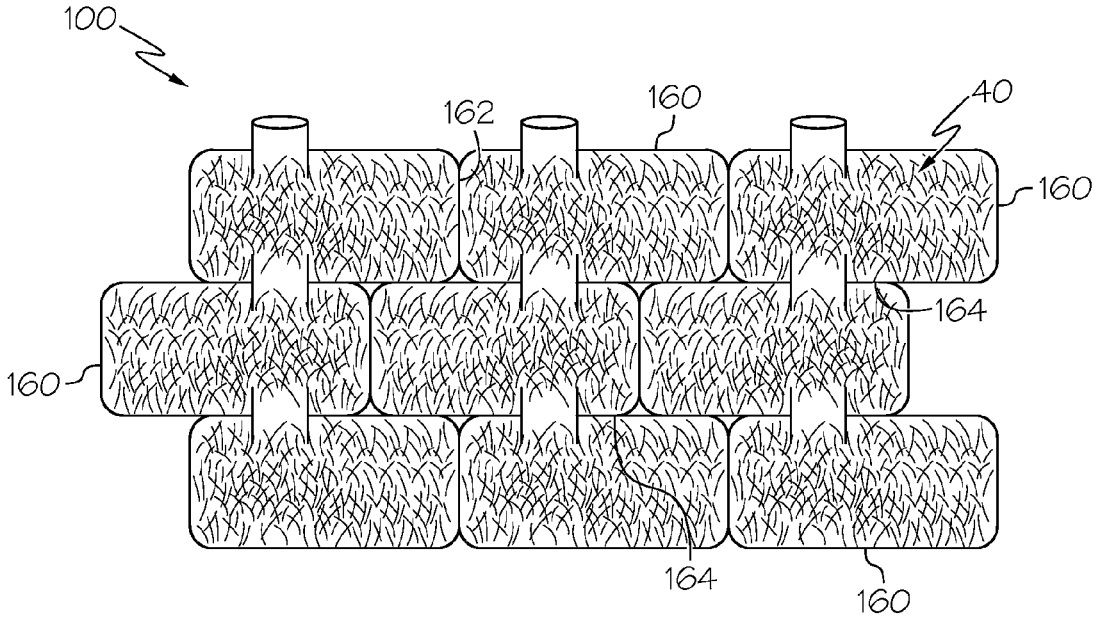
FIG. 6 is a plan view of a revetment panel construction according to another example embodiment of the present invention.

In another example form, the revetment panel construction comprises a staggered brick-like configuration. For example, FIG. 6 shows a revetment panel construction 100 comprising a plurality of brick-like bladders. As similarly described above, the revetment panel construction 100 comprises outer seams 160, length-wise seams 162, and cross-wise seams 164. Preferably, a portion of the cross-wise seams 164 are omitted to allow the filling to flow within and through the brick-like bladders. As depicted, the brick-like bladders are generally staggered similarly to a bricked wall or other blocked structure and the omitted portions are generally aligned in a vertical manner. Optionally, as similarly described above, the omitted portions can be staggered or form a zig-zag pattern or other pattern as desired.

The filling 50 in the elongate bladder can be sand, other loose material, shredded tires, or cementitious material. In one preferred form, the bladder is filled with concrete. In one example form, as depicted in FIG. 2, a hose or pipe P connects to a fill opening 45 of the revetment panel 10 wherein the filling 50 flows therethrough to fill the bladder with the filling 50. Advantageously, gravity provides for allowing the filling 50 to flow from the higher elevated portion of the bladder to the lower elevated portion of the bladder. Additionally advantageous, the length-wise seams 62 and the cross-wise seams 64 provide for a relatively uniform distribution of the filling 50 therein. Further, when water W is present, for example, such as a river bed or stream, the bladder (even if under water) can be filled. Optionally, the elongate bladders can be filled with material that is gathered during dredging.

Figure 7:
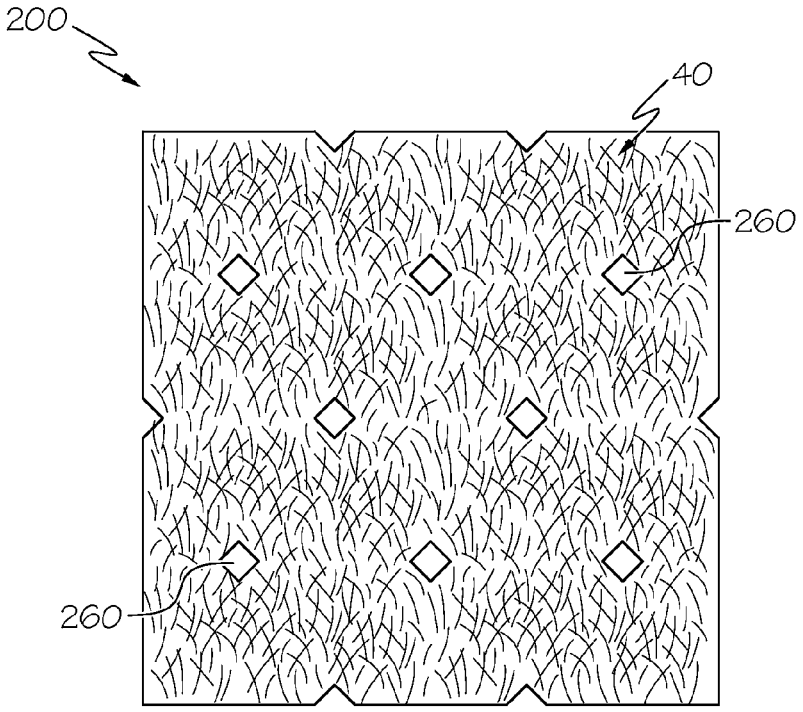
FIG. 7 is a plan view of a revetment panel construction according to yet another example embodiment of the present invention.

FIG. 7 shows a revetment panel construction 200 according to another example embodiment of the present invention. As depicted, the revetment panel construction 200 generally comprises one bladder that includes a plurality of pillow-like portions or connecting members 260 and the synthetic turf 40. As similarly described about, the revetment panel construction generally includes outer seams (unshown) that define the bladder and contain the filling 50 therein. Preferably, the plurality of connecting members 260 extend within the bladder and connect to the sides thereof such that the bladder comprises a plurality of connection points throughout, thus generally depicting a quilted structure. Thus, rather than only permitting the filling 50 to flow within a particular bladder portion of the revetment panel (as depicted in FIGS. 1-2 and 5-6), the bladder of the revetment panel 200 permits the filling 50 to flow anywhere therein while the connecting members 260 provide for quilted-like support. In one example form, the connecting members 260 are generally block shaped and extend from one internal side of the bladder to a generally opposite internal side of the bladder. Preferably, the quantity and configuration of the connecting members 260 can be chosen as desired. Optionally, the connecting members 260 can be sized and shaped as desired. Preferably, the connecting members 260 provide for increasing the rigidity and strength of the revetment panel 200.

Also optionally, the synthetic turf comprises an elongate strip of synthetic turf. For example, rather than fitting the synthetic turf 40 to the size of the geotextile fabric 20, a plurality of elongate strips of synthetic turf can be affixed to the geotextile fabric 20. Preferably, the bladder is elongate and is generally tube-like. In one optional form, two or more of the elongate, generally tube-like bladders are positioned generally abutting one another in side-by-side relationship. Optionally, one or more spacers can be positioned between the bladders.

In use, the revetment panel construction 10 is generally in a rolled-up, compact form when it reaches the desired area to which it is to be placed. Preferably, the end of the panel 10 that comprises the fill opening 45 is generally positioned and secured to the ground G and then the panel 10 is unrolled. After the panel is unrolled and positioned accordingly, the filling 50 can be filled into the bladder.

In a second example embodiment, the revetment panel construction includes a geotextile fabric positioned atop the ground, an elongate filled bladder positioned atop the geotextile fabric, and a synthetic turf positioned atop the filled bladder. Optionally, the synthetic turf comprises synthetic blade-like elements tufted into an upper panel portion of the filled bladder. Also optionally, the synthetic turf comprises an elongate strip of synthetic turf. Preferably, the filled bladder is elongate and is generally tube-like. In one optional form, two or more of the elongate, generally tube-like filled bladders are positioned generally abutting one another in side-by-side relationship. Optionally, a wide seam or spacer can be positioned between the filled bladders.

Advantageously, the revetment panel construction according to the present invention provides good protection against erosion and reinforcement of water control structures. The present revetment panel construction has good durability, low-cost, excellent erosion control and water control, and a rather natural, pleasant appearance.

The revetment panel can be constructed using a more or less conventional style of bladder or panel construction and clad with synthetic turf on the top thereof. Alternatively (and preferably), the revetment panel can be constructed in a manner to omit the normal top layer of the bladder or panel and to replace it with the synthetic turf.

It is to be understood that this invention is not limited to the specific devices, methods, conditions, or parameters of the example embodiments described and/or shown herein, and that the terminology used herein is for the purpose of describing particular embodiments by way of example only. Thus, the terminology is intended to be broadly construed and is not intended to be unnecessarily limiting of the claimed invention. For example, as used in the specification including the appended claims, the singular forms "a," "an," and "the" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the claimed invention has been shown and described in example forms, it will be apparent to those skilled in the art that many modifications, additions, and deletions can be made therein without departing from the spirit and scope of the invention as defined by the following claims.

What is claimed is:

1. A revetment panel construction for placement atop the ground, comprising:

a geotextile fabric to be positioned atop the ground;

a synthetic turf positioned atop the geotextile fabric and affixed thereto in a manner to create a fillable bladder, wherein the synthetic turf comprises a synthetic backing and a plurality of polymer blade-like elements extending from the synthetic backing, wherein the geotextile fabric defines a bottom panel of the fillable bladder and the synthetic turf defines a top panel of the fillable bladder; and wherein the fillable bladder is fillable with a ballast filling to be placed within the bladder.

2. The revetment panel of claim 1, wherein the synthetic turf is affixed to the geotextile fabric by one or more of heat bonding, adhesive bonding, stitches, or mechanical fasteners.

3. The revetment panel of claim 1, wherein the plurality of polymer blade-like elements are tufted into the synthetic backing.

4. The revetment panel of claim 1, wherein the fillable bladder is filled with sand or other loose material.

5. The revetment panel of claim 1, wherein the fillable bladder is filled with cementitious material.

6. The revetment panel of claim 1, wherein the revetment panel comprises a port for receiving a ballast filling therethrough.

7. The revetment panel of claim 1, wherein the bladder is elongate and generally tube-like.

8. The revetment panel of claim 7, wherein the revetment panel comprises two or more of the elongate, generally tube-like filled bladders generally abutting one another.

9. The revetment panel of claim 1, wherein the bladder is effectively divided so as to form pillow-shaped structures in volumetric communication with one another.

10. The revetment panel of claim 1, wherein the bladder is formed by the geotextile fabric positioned atop the ground and the synthetic turf positioned atop the geotextile fabric and secured thereto.

11. A revetment panel placed atop the ground, comprising:

a fillable panel including a lower geotextile fabric positioned atop the ground and an upper synthetic turf positioned over the geotextile fabric, spaced therefrom, and affixed thereto to form at last one seam, wherein the synthetic turf comprises a synthetic backing and a plurality of polymer blade-like elements tufted into the synthetic backing, wherein the geotextile fabric defines a bottom panel of the fillable bladder, the synthetic turf defines a top panel of the fillable bladder, and the at least one seam defines a periphery of the fillable bladder; and a ballast filling placed within the fillable panel.

12. The revetment panel of claim 11, wherein the ballast is sand or other loose material.

13. The revetment panel of claim 11, wherein the ballast is cementitious material.

14. The revetment panel of claim 11, wherein the ballast is concrete.

15. The revetment panel of claim 11, wherein the fillable panel is elongate and generally tube-like.

16. The revetment panel of claim 11, wherein the fillable panel comprises an upper sheet and wherein the synthetic turf is affixed to the upper sheet.

17. The revetment panel of claim 11, wherein the synthetic turf comprises an elongate strip of synthetic turf.

18. The revetment panel of claim 11, wherein the fillable panel comprises a plurality of the fillable panels in volumetric communication with each other so that the ballast flows between the plurality of the fillable panels.

19. The revetment panel of claim 11, wherein the blade-like elements tufted into the synthetic backing of the synthetic turf comprise a UV-resistant material.

20. A revetment panel construction for placement atop the ground, comprising:

a lower geotextile fabric panel to be positioned atop the ground;

an upper panel attached to the lower panel to create a fillable bladder; and a synthetic turf positioned atop the upper panel and affixed thereto, wherein the synthetic turf comprises a synthetic backing and a plurality of polymer blade-like elements tufted into the synthetic backing; and wherein the fillable bladder is fillable with a ballast filling to be placed within the bladder.

* * * * *